US009421550B2

(12) United States Patent
Glauberman et al.

(10) Patent No.: US 9,421,550 B2
(45) Date of Patent: Aug. 23, 2016

(54) VERTICAL SUPPORT MEMBER FOR INTERMEDIATE YOKES ON COMMINUTOR CUTTER SHAFTS

(71) Applicant: JWC ENVIRONMENTAL, LLC, Costa Mesa, CA (US)

(72) Inventors: Corey Glauberman, Tustin, CA (US); Robert Sabol, Aliso Viejo, CA (US); Bruce R. Hamlett, Howell, MI (US)

(73) Assignee: JWC Environmental, LLC, Costa Mesa, CA (US)

( * ) Notice: Subject to any disclaimer, the term of this patent is extended or adjusted under 35 U.S.C. 154(b) by 521 days.

(21) Appl. No.: 13/628,725

(22) Filed: Sep. 27, 2012

(65) Prior Publication Data

US 2014/0084095 A1 Mar. 27, 2014

(51) Int. Cl.
*B02C 18/16* (2006.01)
*B02C 18/14* (2006.01)

(52) U.S. Cl.
CPC ..... *B02C 18/16* (2013.01); *B02C 18/142* (2013.01); *Y10T 29/49826* (2015.01)

(58) Field of Classification Search
CPC ..... B02C 2018/0046; B02C 18/16; B02C 18/0084; B02C 18/142; Y10T 29/49826
USPC ..... 241/46.01, 46.06, 73, 74, 285.1
See application file for complete search history.

(56) References Cited

U.S. PATENT DOCUMENTS

| | | | | |
|---|---|---|---|---|
| 4,046,324 | A * | 9/1977 | Chambers | 241/46.06 |
| 5,354,004 | A * | 10/1994 | Chambers et al. | 241/236 |
| 5,829,697 | A * | 11/1998 | Kroger | 241/236 |
| 7,641,138 | B1 * | 1/2010 | Lo | 241/236 |
| 2001/0032755 | A1 * | 10/2001 | Prodan | 184/84 |
| 2003/0089806 | A1 * | 5/2003 | Galanty | 241/46.06 |
| 2010/0096484 | A1 * | 4/2010 | Jiang | 241/285.1 |
| 2010/0176231 | A1 * | 7/2010 | Jiang | 241/101.2 |
| 2014/0061348 | A1 * | 3/2014 | Wei | 241/285.1 |

* cited by examiner

*Primary Examiner* — Mark Rosenbaum
(74) *Attorney, Agent, or Firm* — Sughrue Mion, PLLC

(57) ABSTRACT

A comminutor for reducing the particle size of solid waste is provided. The comminutor includes at least two shafts, each fitted with a cutting element. A top portion of each of the shafts is rotatably mounted to a top housing and a bottom portion of each of the shafts is rotatably mounted to a bottom housing. The comminutor also includes a first shaft support disposed between the top portion and the bottom portion for rotatably supporting each of the shafts and a vertical support member attached to the top housing and the bottom housing, the first shaft support being coupled to the vertical support member.

14 Claims, 14 Drawing Sheets

GENERATION 1 - 1992
FIXED SUPPORT
EXTENDED HEIGHT GRINDERS

VERTICAL SUPPORT MEMBER FOR INTERMEDIATE YOKES ON COMMINUTOR CUTTER SHAFTS

BACKGROUND OF THE INVENTION

1. Field of the Invention

Apparatuses and methods consistent with the present invention relate to comminutors for treating solid material in a liquid waste stream containing solid waste.

2. Description of the Related Art

By definition, comminution is the reduction of particle size of solid waste material to minute particles. The comminution or the reduction of particle size of solid waste material into fine particles is performed by feeding solid waste material into the interface of counter-rotating intermeshed cutting elements while entrained in a liquid. These cutting elements may be in the form of a disk and may have projecting cutting teeth which overlap during rotation. The solids are then sheared and shredded by the action of the adjacent rotating elements, i.e., comminutors.

However, the cutter shafts of a dual shafted comminutor assembly tend to deflect away from each other when macerating heavy solids. If this deflection becomes excessive, the solids may not be completely ground. The deflection may also induce shaft failure, and if excessive enough, may damage adjacent components by direct contact.

In the related art as shown in FIG. 1, the counter-rotating cutter stacks 44 and 46 comprise an alternating sequence of cutting elements 48 and spacers 50 fitted over a shaft 5, 68. The overlap and counter-rotation occurring on zone 52 shreds the material as it passed through the cutter elements. The deflection of the cutter shafts may be limited by installing one or more floating intermediate shaft supports 10 along the cutter stacks 44, 46 which are held in place by the compression of the cutter stack elements allowing them to float as they operate. The downside to these intermediate shaft supports is that they wear unevenly due to side and axial loads that occur from macerating forces and gravity. The result is premature wear that typically requires part replacement before the cutter stack requires replacing. Over time, improvements made to the floating design include lubrication ports and improved bushing materials, but these improvements have only resulted in incremental improvements in wear life. Thus, there is a need to improve the wear characteristics of these floating intermediate shaft supports 10.

As shown in FIGS. 2A-3A, each intermediate shaft support 10, also known as a yoke, is a passive device used to prevent the deflection of dual-shafted comminutor cutter stacks 44, 46 while macerating. It is comprised of two housings 20 or brackets fastened together and contain four friction reducing bushings 30 and two rotating inner races 40. Two bushings 30 are press-fit into each of the two machined bores of each housing 20. The two inner races 40 are then installed in each bushing 30 of one housing 20 and are then enclosed by the second housing 20, which are fastened using bolts 60, for example, to create a contained intermediate shaft support 10. Each inner race 40 has a close clearance fit to the bushings 30 which allows the races to rotate freely. Each inner race 40 may have a profile so as to engage and rotate with the shape of the cutter shafts 5,68. In this embodiment, the shape of the cutter shafts is hexagonal. The inner races may have a hex-shaped profile as shown in FIG. 3A.

The inner races 40 operate similar to bearing inner races, except that the mode of rotation is by the fixed bushings as opposed to rolling bearing balls or rollers. One or more intermediate shaft supports 10 are installed on the two cutter shafts 5, 68 at strategic locations relative to the cutters and spacers, with each support yoke taking the place of approximately four cutters and spacers on each shaft. The brackets have lubrication ports to allow for external addition of lubrication once the components are assembled and installed.

While these intermediate shaft supports have conventionally been floating, in one application where the cutters are sandwiched between two adjacent walls, the intermediate shaft support 10 was formed with side wall portions 11 that were bolted to the two adjacent walls for the purposes of maintaining the position of the walls as shown in FIGS. 3B-3D.

FIGS. 9 and 10 shows a comminutor in the related art having a intermediate shaft support 10 installed on the cutter stacks 46 that are disposed between two rotating screens 48. As is evident from these figures, removal and maintenance of the intermediate shaft support 10 requires substantial time an effort as the comminutor must be disassembled to access the intermediate shaft support.

However, these intermediate shaft supports are prone to wear. As such, the comminutor assembly must be periodically taken out of service for maintenance. This maintenance may include merely shutting down the comminutor to lubricate the shaft support, but eventually, the comminutor assembly, including the two cutter shafts, must be disassembled to rebuild or replace the intermediate shaft supports.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

According to one aspect of the invention, a comminutor is provided for reducing the particle size of solid waste. The comminutor comprises two shafts each fitted with a cutting elements. A top portion of each of shaft is rotatably mounted to a top housing and a bottom portion of each shaft is rotatably mounted to a bottom housing. A first shaft support is disposed between the top portion and the bottom portion for rotatably supporting each of the shafts. A vertical support member is attached to the top housing and the bottom housing, the first shaft support being coupled to the vertical support member.

According to another aspect, the comminutor further comprises a second shaft support disposed between the top portion and the bottom portion for rotatably supporting each of the shafts, the second shaft support is spaced apart from the first shaft support.

According to another aspect, the vertical support shaft comprises an internal channel. Also included is a lubrication line extending from the top housing to the first shaft support. A least a portion of the lubrication line lies within the internal channel. One end of the lubrication line is connected to the first shaft support and the second end of the lubrication line is fitted with a fitting configured to receive lubrication.

According to another aspect, the first shaft support is coupled to the vertical support member using an adjustable friction fitting. The vertical support member has a cross-section having a U-shape or an I-shape and the vertical support member is disposed downstream of the two shafts with respect to the direction of waste flow through the comminutor.

According to another aspect, a vertical support member is provided. The vertical support member comprises a beam member having an internal passage, a top and a bottom; an adjustable bracket disposed between the top and the bottom of the beam member; a fitting for adjustably fixing the adjustable bracket to the beam member.

According to another aspect, the vertical support member comprises a top bracket fixed to a top of the beam member and a bottom bracket fixed to the bottom of the beam member. The vertical support member may also comprise a lubrication line extending from the top of the beam member to the adjustable bracket.

According to another aspect, a method for assembling a vertical support member is provided. The method comprises preparing a top housing and bottom housing of a comminutor for attachment to a top and bottom of a vertical support member, respectively; securing the vertical support member to the top and the bottom of the top housing and the bottom housing; preparing an intermediate shaft support for attachment to an adjustable bracket of the support member; securing the intermediate shaft support to the adjustable bracket; running a lubrication line from the top of the vertical support member to the adjustable bracket and securing the lubrication line to the vertical support member; and connecting the lubrication line to the intermediate shaft support.

BRIEF DESCRIPTION OF THE DRAWINGS

The above and/or other aspects of the present invention will be more apparent by describing certain exemplary embodiments of the present invention with reference to the accompanying drawings, in which.

DETAILED DESCRIPTION OF THE EXEMPLARY EMBODIMENTS

Figure 1:
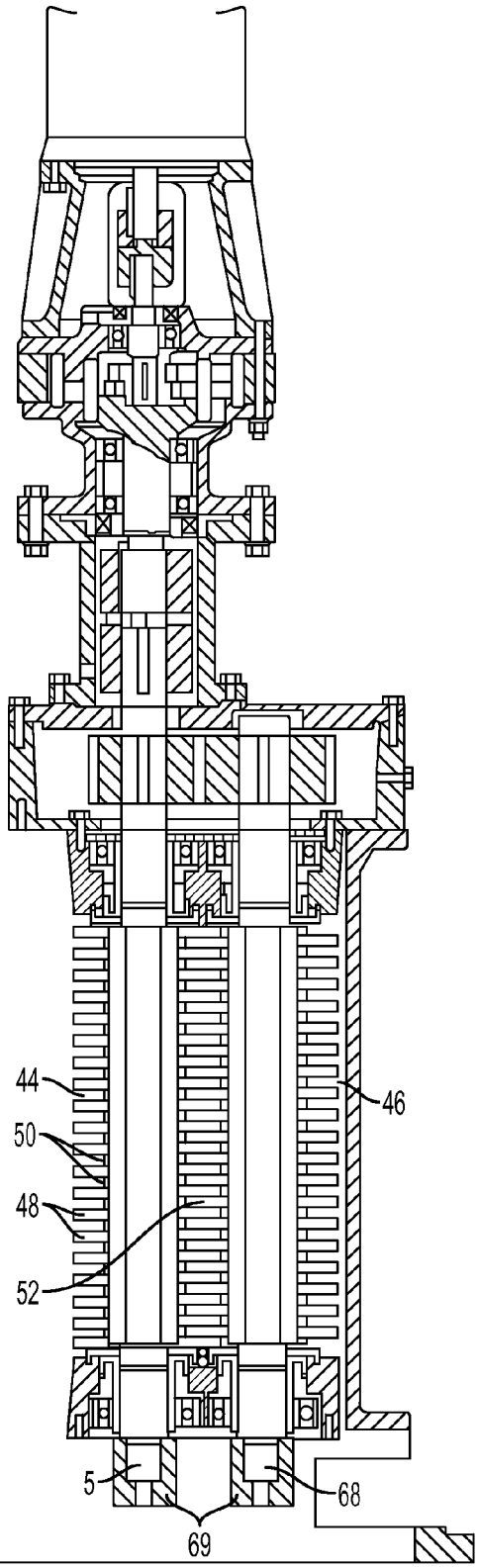
FIG. 1 PRIOR ART
FIG. 1 shows a comminutor in the prior art which does not include a vertical support member.
Figure 2A:
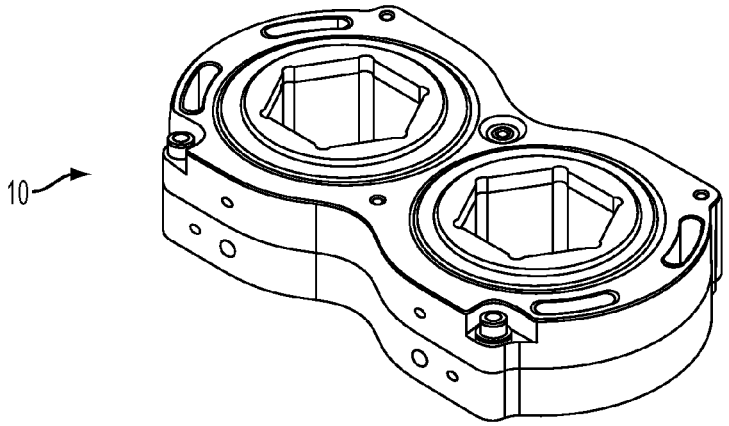
FIG. 2A PRIOR ART
FIGS. 2A and 2B show a cross-sectional view and a perspective view of a shaft support in the prior art.
Figure 2B:
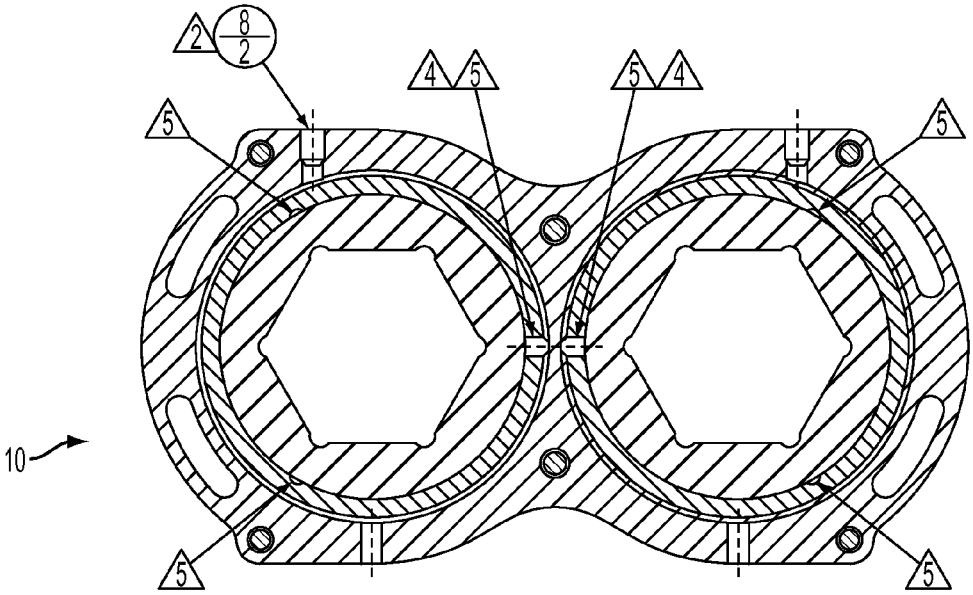
FIG. 2B RELATED ART
Figure 3A:
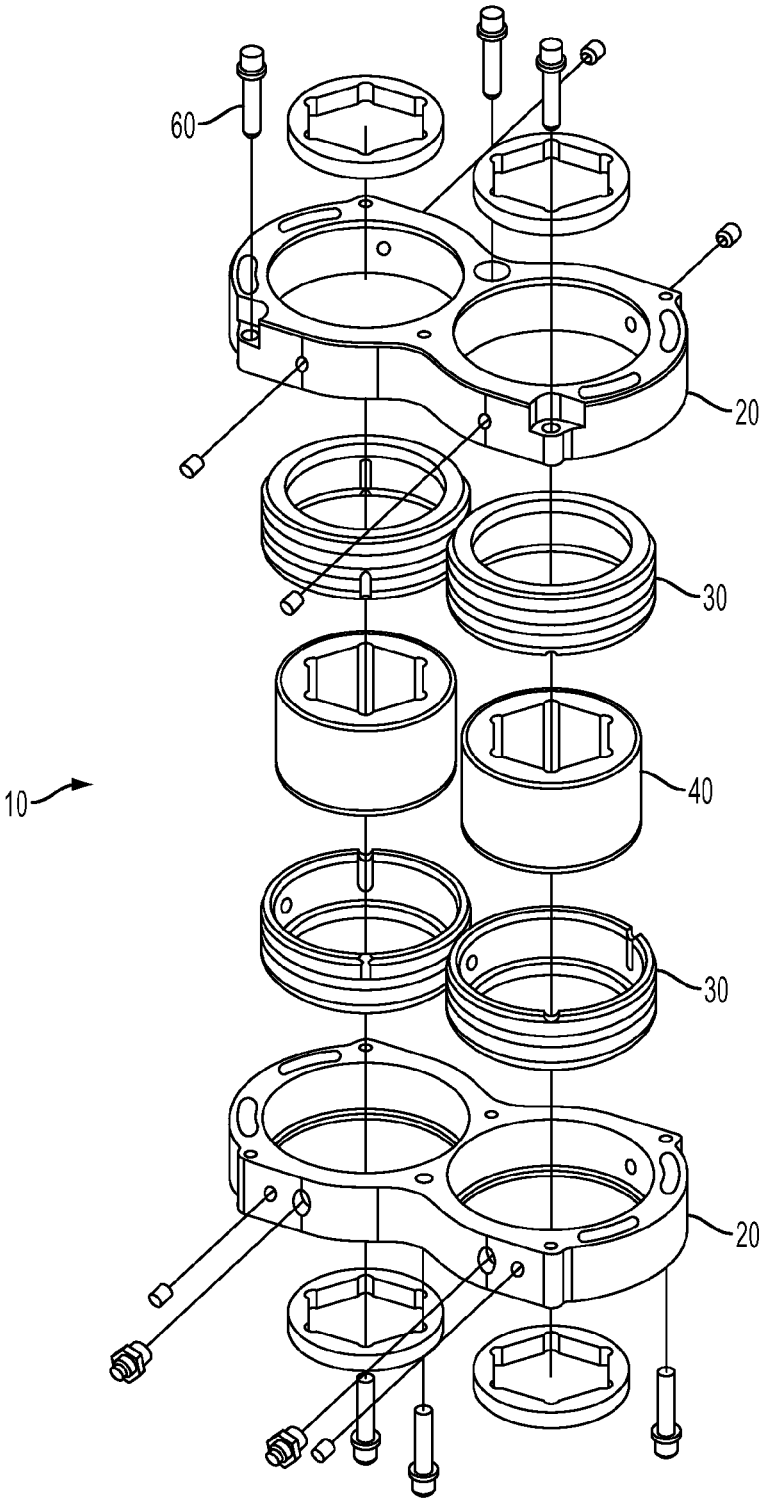
FIG. 3A RELATED ART
FIG. 3A shows an exploded view of the shaft support in the prior art.
Figure 3B:
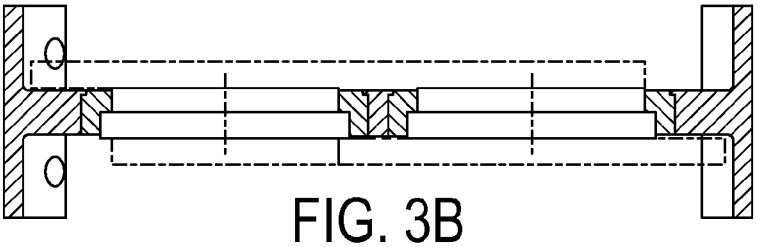
FIGS. 3B-3D shows an intermediate shaft support in the prior art.
Figure 3C:
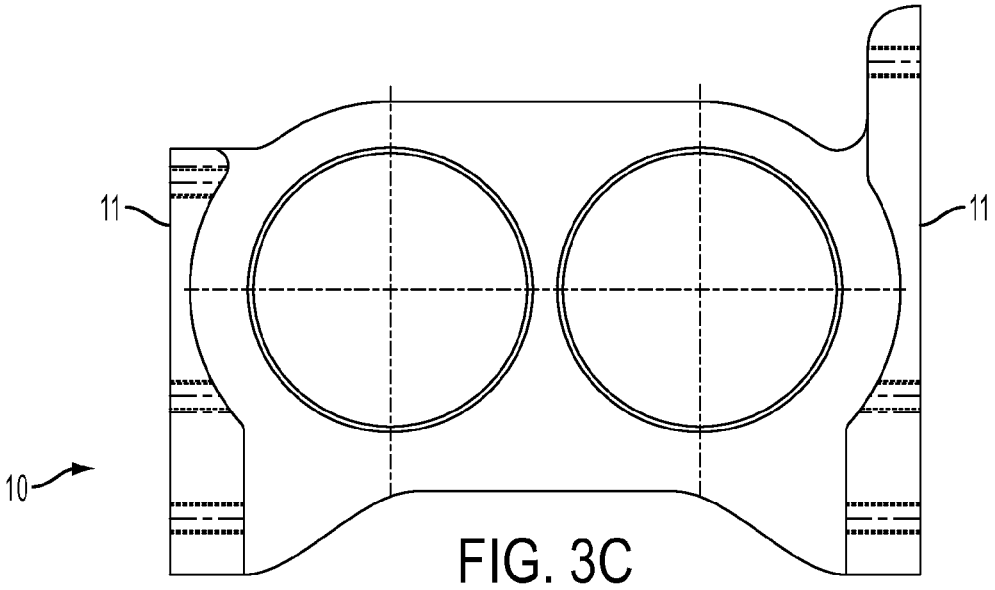
Figure 3D:
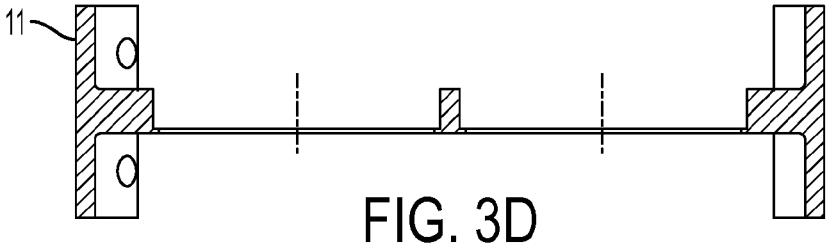
FIG. 3D RELATED ART

Certain exemplary embodiments of the present invention will now be described in greater detail with reference to the accompanying drawings.

In the following description, the same drawing reference numerals are used for the same elements even in different drawings. The subject matter described in the description, such as detailed construction and elements, are provided to assist in a comprehensive understanding of the invention. Thus, it is apparent that the present invention can be carried out without those specifically described matters.

The foregoing exemplary embodiments are merely exemplary and are not to be construed as limiting the present invention. The present teaching can be readily applied to other types of methods and apparatuses. Also, the description of the exemplary embodiments of the present invention is intended to be illustrative, and not to limit the scope of the claims, and many alternatives, modifications, and variations will be apparent to those skilled in the art.

Figure 4B:
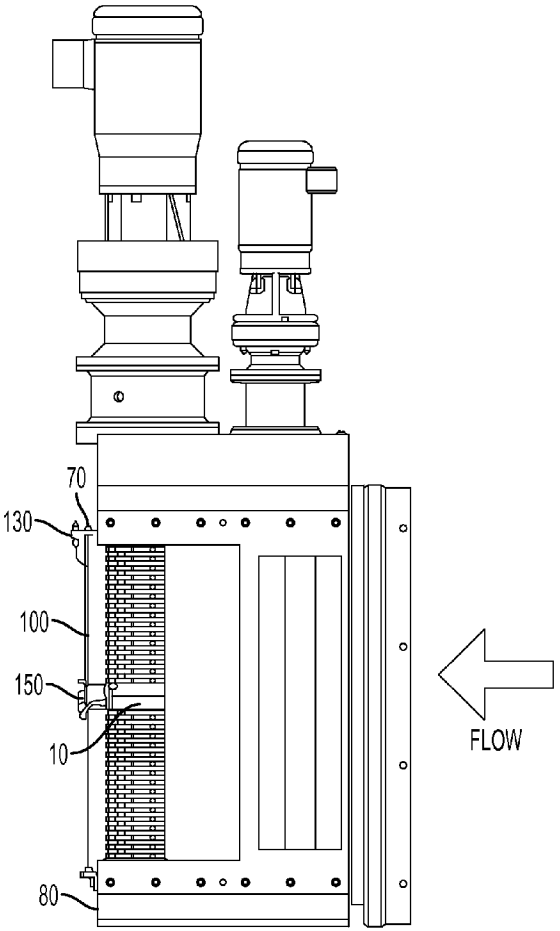
FIGS. 4A and 4B show a comminutor in accord with an embodiment having a vertical support member in accord with an embodiment of the present invention.
Figure 4A:
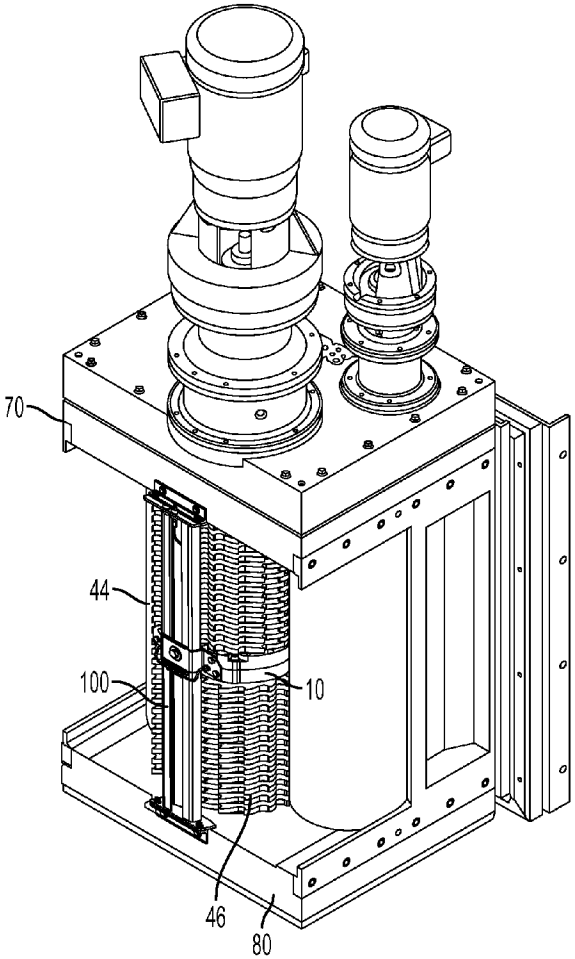
Figure 5:
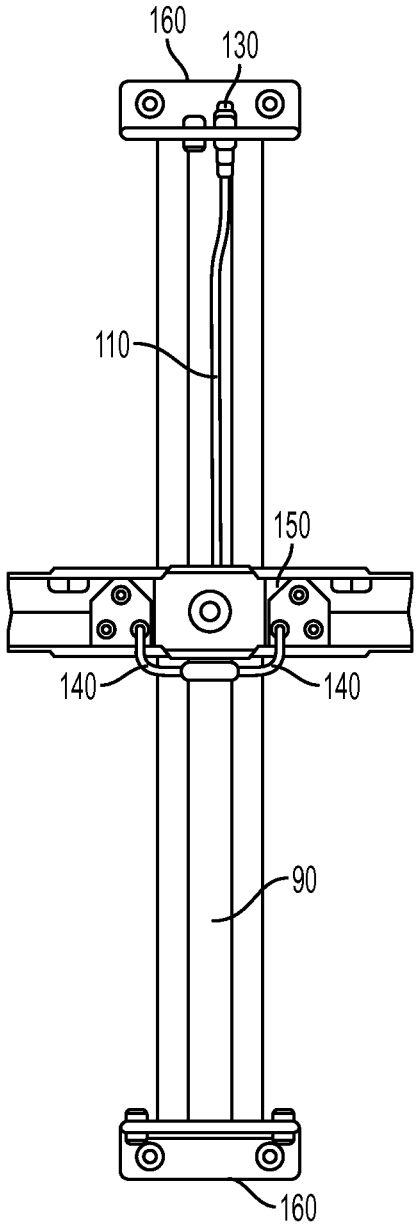
FIG. 5 shows a view facing upstream of a just vertical support member attached to a shaft support according to an embodiment.

As illustrated in FIGS. 4A and 4B, to improve the wear characteristics of the intermediate shaft support 10, a vertical support member 100 is provided between a top and bottom housing of at the discharge side of the comminutor. The vertical support member 100 is configured to support one or more intermediate shaft supports 10.

In this embodiment, as shown in FIGS. 5-8, the vertical support member 100 is made from sheet metal formed into a structural profile, e.g., a U-shape or I beam shape, which gives it high rigidity and allows for an internal protected channel 90 (inside of the U). However, the support member 100 may be formed in other shapes that provide structural rigidity as well as an internal channel 90. The internal channel 90 provides protection for lubrication line(s) 110, which provide the ability to lubricate the intermediate shaft supports 10 during operation of the comminutor.

The vertical support member 100 may be fastened to the top 70 and bottom 80 housings of the comminutor. By fastening the vertical support member 100 in this manner, the support is stably secured by the same members that support the cutter stacks 44, 46.

In this embodiment, the vertical support member 100 is mounted in close proximity to the cutters 44, 46 and shaft supports 10 via adjustable mounting brackets 160 on the discharge side of the comminutor by attachment to both the top housing 70 and the bottom housing 80. FIG. 4 shows the direction of the waste flow. An additional mounting bracket 150 affixes each shaft support 10 assembly to the vertical support member 100 with an infinitely adjustable, positive engagement friction mechanism that allows each yoke support assembly to mount anywhere along the cutter stack. However, the shaft supports 10 may be mounted using a bolt assembly or some other fixing member.

Figure 6A:
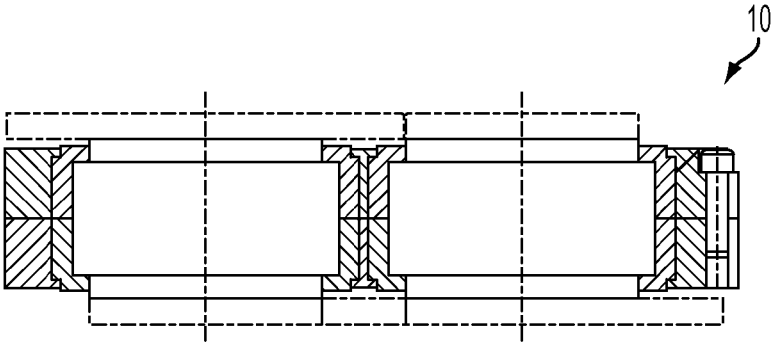
FIGS. 6A and 6B shows a cross-sectional view and a top view of a shaft support mounted to a vertical support member.
Figure 6B:
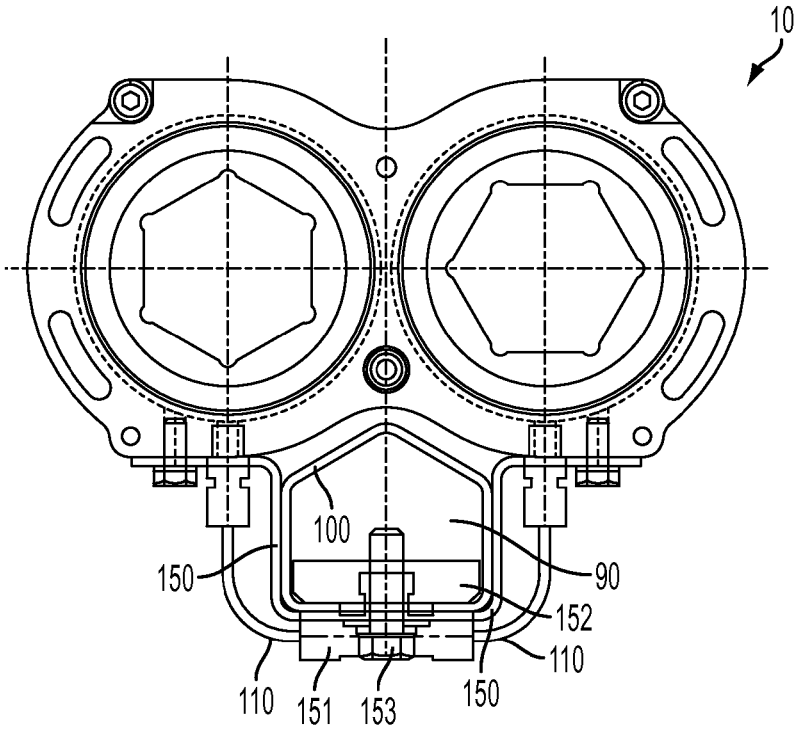
Figure 7:
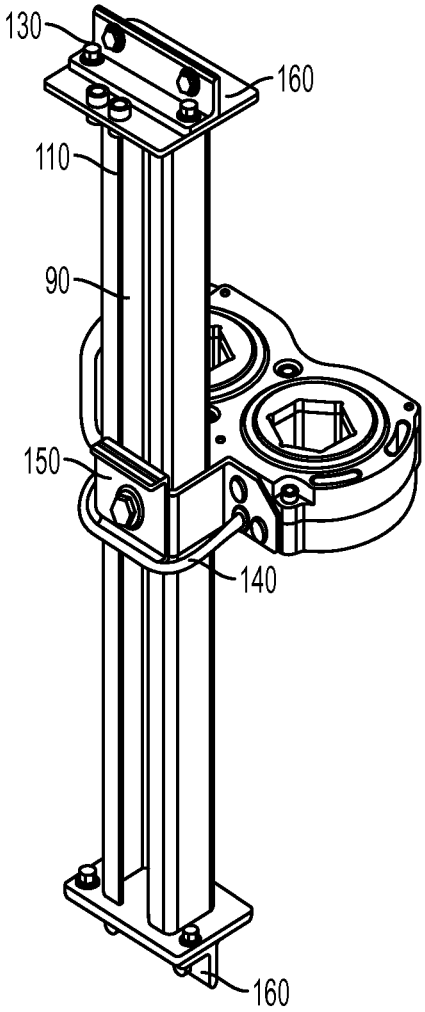
FIG. 7 shows a perspective view of a shaft support mounted to a vertical support member.

As shown in FIGS. 6A-6B, the mounting bracket 150 in this embodiment is comprised of an internal collar 152 that is secured using a bolt 153 to frictionally fix the intermediate shaft support 10 to the vertical support member 100.

Once the support shafts 10 are attached using the mounting brackets 150, a first end 130 of each of the two tubular lubrication lines 110 are connected to each shaft support 10 on the comminutor discharge side near the location of the rotating races. The lubrication lines 110 are then routed into the internal channel 90 and extend upward through the internal channel 90 to the top mounting bracket 160 to terminate at a first end 130.

In this embodiment, the second ends 140 of the lubrication lines 110 are joined into a single lubrication line at a tee 151 before extending upward through the channel. Thus, only one lubrication lines extends to the first end 130 which terminates with a lubrication fitting that contains a ball-check valve. Additional distance may be achieved with a longer lubrication run for each shaft support 10. Optionally, the system may be equipped without tubular lubrication lines in which each support bracket is terminated with two ball-check valve lubrication fittings mounted locally (known as local lubrication type). A second optional configuration (known as automatic lubrication type) uses the tubular lubrication lines terminating at the top of the vertical support member as previously mentioned. However, instead of terminating with ball-check valve fittings, each lubrication line is connected to a remotely mounted powered automatic lubrication device which delivers lubrication to each support yoke at controlled predetermined time intervals.

Figure 8:
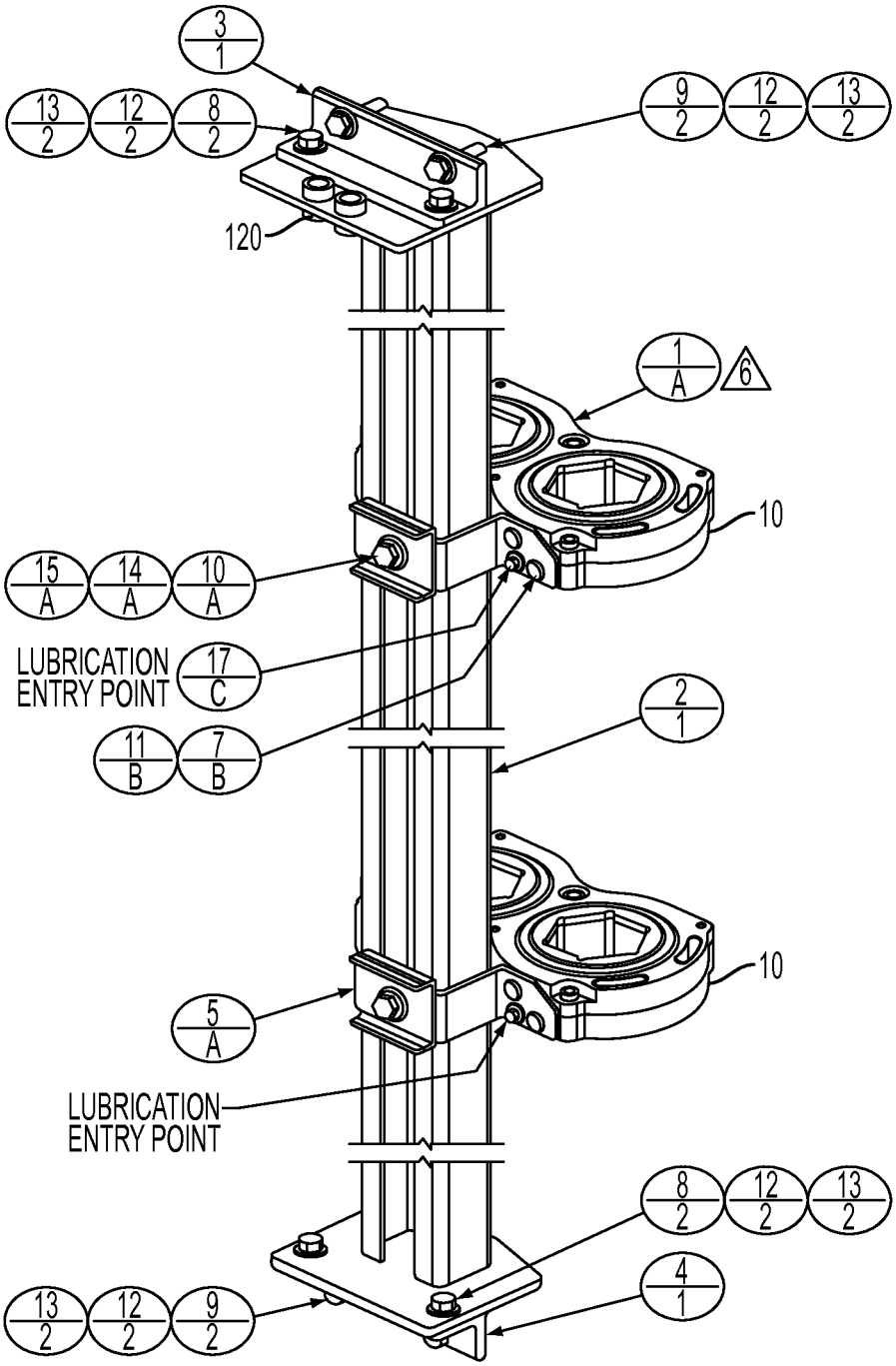
FIG. 8 shows two shaft supports mounted to a single vertical support member in accord with another embodiment.
Figure 9:
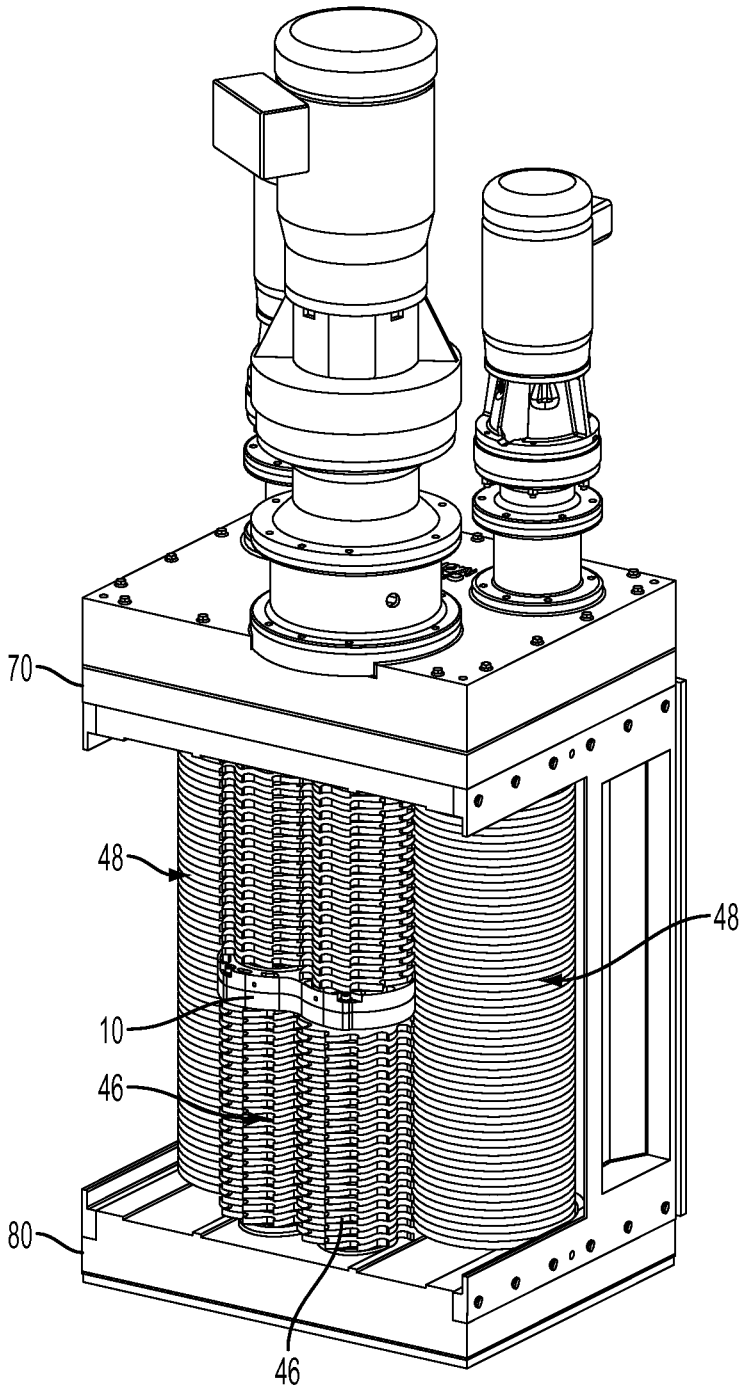
FIG. 9 PRIOR ART
FIGS. 9 and 10 show a comminutor in the prior art that does not include support for the intermediate support member.
Figure 10:
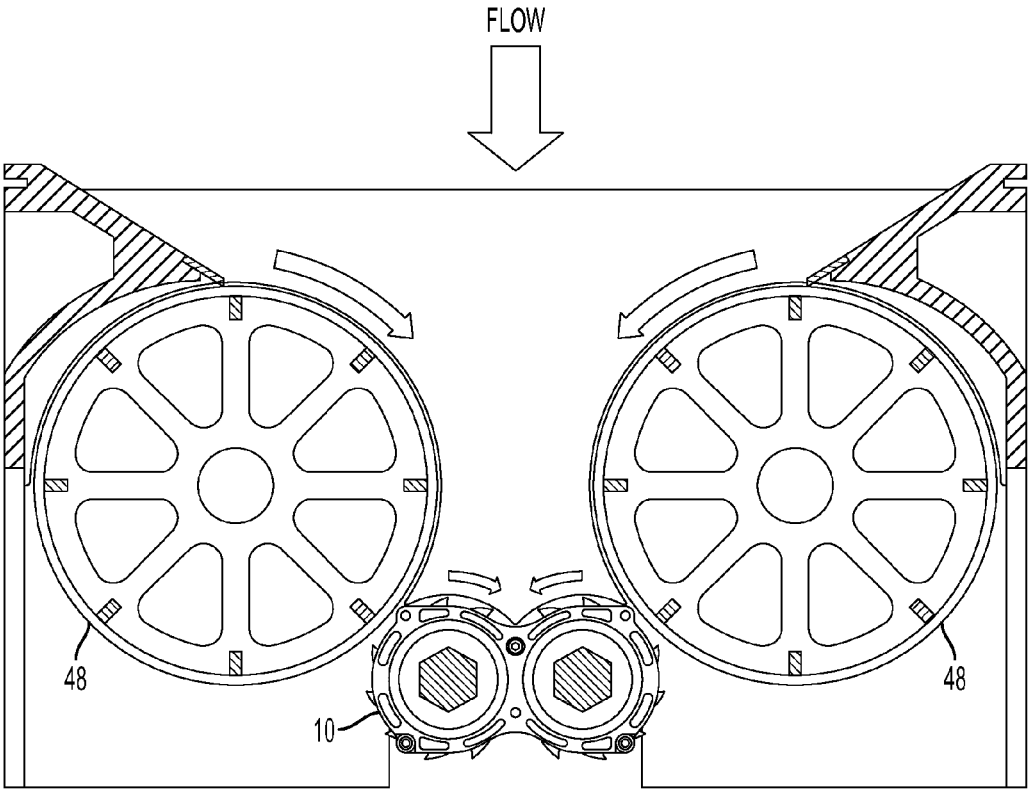
FIG. 10 PRIOR ART

As shown in FIG. 8, multiple shaft supports 10 may be placed on a single vertical support member 100. Here, a single lubrication line may be branched to supply each shaft support 10. Alternatively, each shaft support 10 may have its own lubrication line extending to the top of the vertical support member 100.

Figure 11:
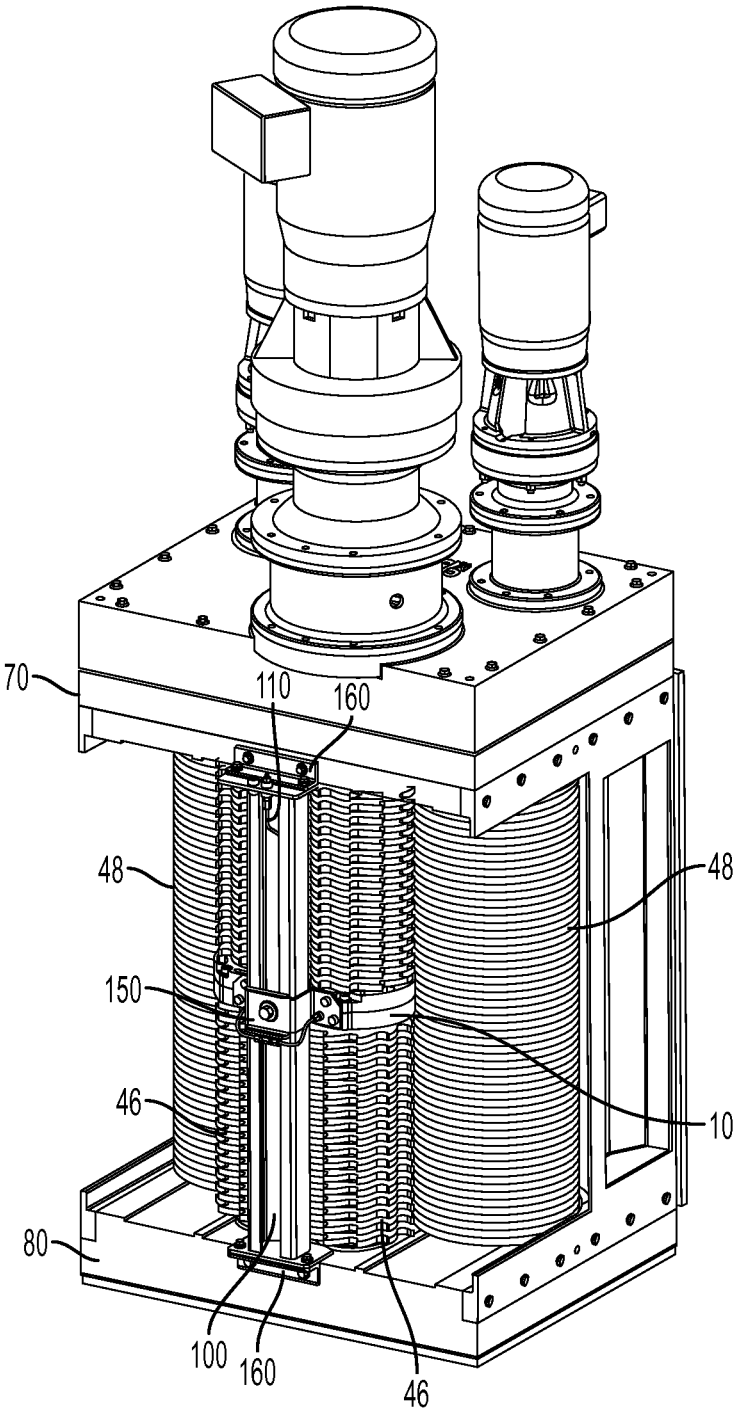
FIGS. 11 and 12 show a comminutor fitted with a vertical support member in accord with the present invention.
Figure 12:
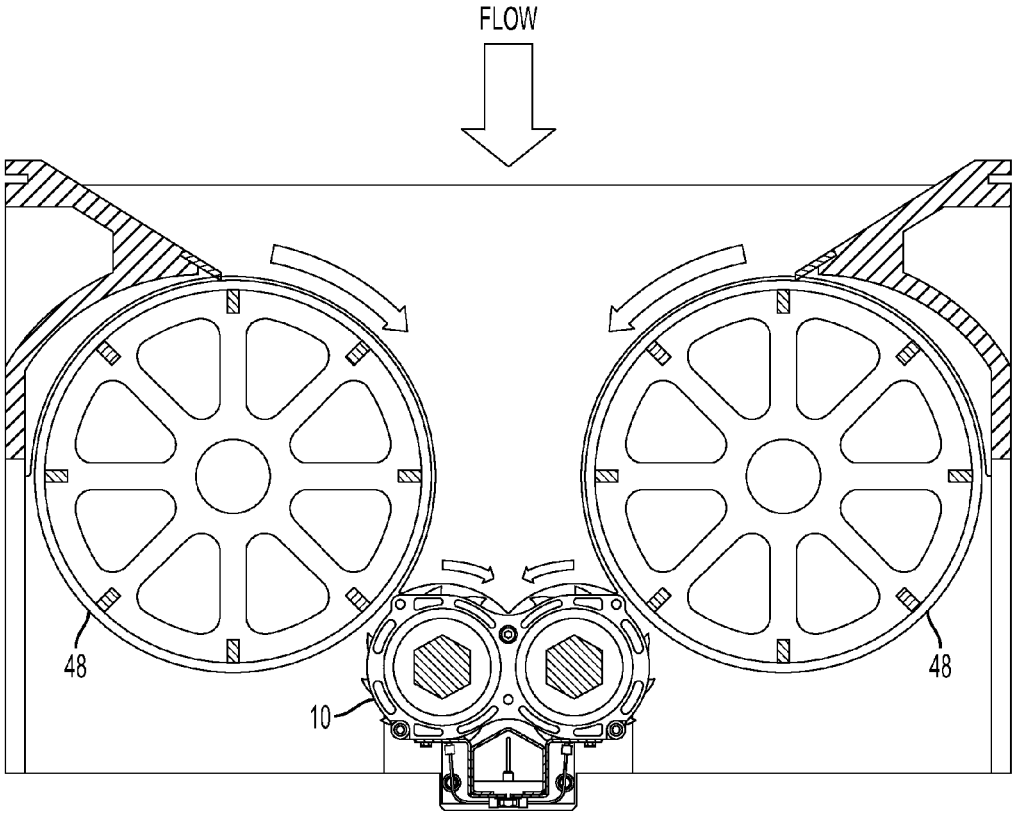

FIGS. 11 and 12 show a vertical support member 100 supporting an intermediate shaft support 10 in accord with another embodiment. The vertical shaft support is positioned in the downstream flow direction with respect to the cutter stacks 46. It is mounted to the top and bottom housings 70, 80 using a bracket 160. The intermediate shaft support 10 is then attached to the vertical support member 100 using an infinitely adjustable bracket 150. The lubrication lines 110 are connected to each side of the intermediate shaft support 10 and then routed to the top of the vertical support member 100. Each lubrication line 110 may be connected together into a single line 110 for extending to the top of the vertical support member 100. As such, lubrication may be applied to the intermediate shaft support 10 during operation of the comminutor. Additionally, because the lubrication lines 110 can be accessed at all time, lubrication can be applied using an automated system either intermittently or continuously.

Figure 13:
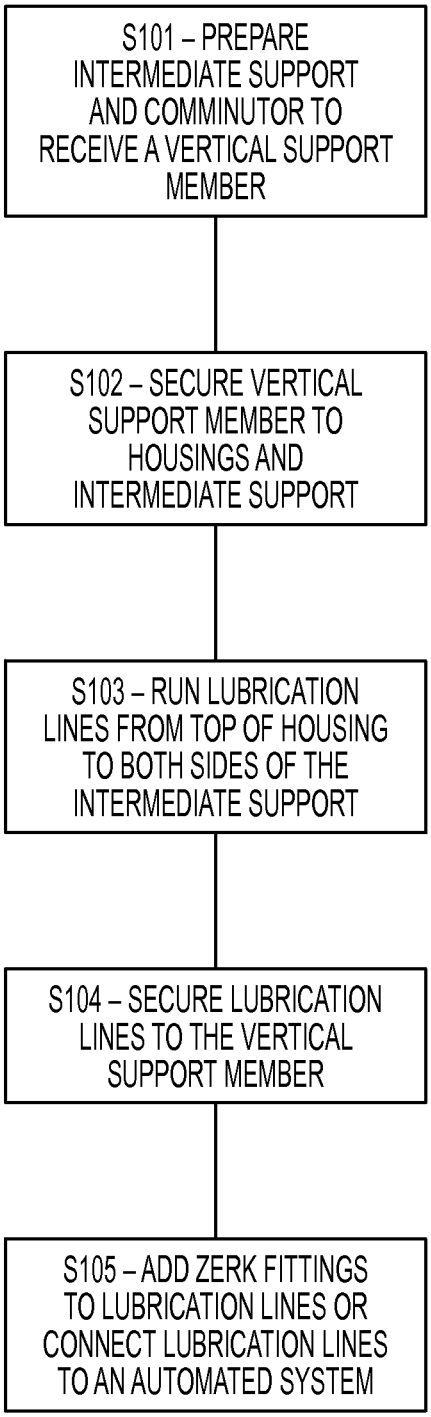
FIG. 13 is a flow chart depicting a method of fitting a comminutor with a vertical support member.

FIG. 13 depicts a flow diagram that shows a method of retrofitting a comminutor with a vertical shaft support 100. First, holes are added to the intermediate shaft support so that the support can be secured to the bracket 150 which is mounted on the vertical support member (S101). The top and bottom housings are also fitted with holes so that the vertical support member can be secured to these portions (S101). Next, the vertical support member 100 is fixed to the top housing and the bottom housing (S102). Then, the intermediate shaft support 10 is attached to the vertical support member 100 using an infinitely adjustable bracket 150 (S102). After securing the vertical support member 100 in this manner, lubrication lines 110 are run from the top of the comminutor to each intermediate shaft support 10 (S103). The lubrication lines are then secured to the vertical support member 100 (S104). Lastly, the top of the lubrication lines 110 are then either fitted with zerk fittings or connected to an automated lubrication system.

While this invention has been particularly shown and described with reference to exemplary embodiments thereof, the above description should be considered in as illustrations of the exemplary embodiments only and are not for purposes of limitation. Therefore, the scope of the invention is defined not by the detailed description of the invention but by the appended claims, and all differences within the scope will be construed as being included in the present invention. Additionally, the features described in the various embodiments are not exclusive in that a feature of one embodiment may be incorporated into another embodiment.

What is claimed is:

1. A comminutor for reducing the particle size of solid waste, the comminutor comprising:

a top housing and a bottom housing defining a channel configured to receive a flow containing the solid waste entrained in a liquid from an upstream side;

two shafts, each fitted with cutting elements;

a top portion of each of the shafts rotatably mounted to the top housing;

a bottom portion of each of the shafts rotatably mounted to the bottom housing;

a first shaft support disposed between the top portion and the bottom portion for rotatably supporting each of the shafts; and a vertical support member attached to the top housing and the bottom housing at a downstream side of the two shafts, the first shaft support being coupled to the vertical support member.

2. The comminutor according to claim 1, further comprising a second shaft support disposed between the top portion and the bottom portion for rotatably supporting each of the shafts, the second shaft support being spaced apart from the first shaft support.

3. The comminutor according to claim 1, wherein the vertical support member of comprises an internal channel.

4. The comminutor according to claim 3, further comprising a lubrication line extending from the top housing to the first shaft support, at least a portion of the lubrication line lying within the internal channel.

5. The comminutor according to claim 4, wherein one end of the lubrication line is connected to the first shaft support and the second end of the lubrication line is fitted with a fitting configured to receive lubricant.

6. The comminutor according to claim 1, wherein the first shaft support is coupled to the vertical support member using an adjustable friction fitting.

7. The comminutor according to claim 1, wherein the vertical support member has a cross-section having a U-shape or an I-shape.

8. The comminutor according to claim 2, wherein the vertical support member comprises an internal channel.

9. The comminutor according to claim 8, further comprising a lubrication line extending from the top housing to the first shaft support, at least a portion of the lubrication line lying within the internal channel; and a second lubrication line extending from the top housing to the second shaft support, at least a portion of the lubrication line lying within the internal channel.

10. The comminutor according to claim 9, wherein one end of each of the lubrication lines is connected to the first shaft support or the second shaft support and the second ends of the lubrication lines are fitted with a fitting configured to receive lubrication.

11. The comminutor according to claim 2, wherein the first shaft support and the second shaft support are each coupled to the vertical support member using an adjustable friction fitting.

12. The comminutor according to claim 2, wherein the vertical support member has a cross-section having a U-shape or an I-shape.

13. The comminutor according to claim 1, wherein the vertical support member is disposed to be centered on the first shaft support when viewed from the downstream side.

14. The comminutor according to claim 1, wherein the vertical support member is disposed to be centered between the cutting elements when viewed from the downstream side.

* * * * *